US006601874B1

(12) United States Patent
Amitrano

(10) Patent No.: US 6,601,874 B1
(45) Date of Patent: Aug. 5, 2003

(54) BOOKBINDING REPAIR KIT

(76) Inventor: Gennaro Raffaele Amitrano, 37 Trent Street, Island Bay, Wellington (NZ)

( * ) Notice: Subject to any disclaimer, the term of this patent is extended or adjusted under 35 U.S.C. 154(b) by 0 days.

(21) Appl. No.: 09/646,554

(22) PCT Filed: Mar. 19, 1998

(86) PCT No.: PCT/NZ98/00037

§ 371 (c)(1),
(2), (4) Date: Sep. 19, 2000

(87) PCT Pub. No.: WO99/47363

PCT Pub. Date: Sep. 23, 1999

(51) Int. Cl.[7] ..... B42C 9/00; B42D 1/00

(52) U.S. Cl. ..... 281/51; 281/15.1; 281/19.1; 281/20; 281/21.1; 281/28; 281/34; 281/35; 281/36; 412/4; 412/8; 412/26; 412/28; 412/36

(58) Field of Search ..... 281/15.1, 19.1, 281/20, 21.1, 28, 51, 34, 35, 36; 412/4, 8, 26, 28, 36

(56) References Cited

U.S. PATENT DOCUMENTS

| | | | | | |
|---|---|---|---|---|---|
| 3,572,767 | A | * | 3/1971 | Learned et al. | 281/29 |
| 3,749,423 | A | * | 7/1973 | Abildgaard et al. | 281/21.1 |
| 3,811,998 | A | * | 5/1974 | James | 156/216 |
| 3,915,778 | A | * | 10/1975 | Carter et al. | 156/196 |
| 3,964,769 | A | * | 6/1976 | Shatzkin | 156/908 |
| 4,019,758 | A | * | 4/1977 | Heller et al. | 156/274.8 |
| 4,091,487 | A | * | 5/1978 | Axelrod | 281/21.1 |
| 4,209,187 | A | * | 6/1980 | Forrest | 281/19.1 |
| 4,420,282 | A | * | 12/1983 | Axelrod | 412/19 |
| 4,596,408 | A | * | 6/1986 | Carter et al. | 281/29 |
| 4,744,592 | A | * | 5/1988 | Barnette et al. | 281/15.1 |
| 4,879,149 | A | * | 11/1989 | Barnett | 281/15.1 |
| 4,893,979 | A | * | 1/1990 | Alpers | 281/15.1 |
| 5,017,070 | A | * | 5/1991 | Barnette | 412/4 |
| 5,203,590 | A | * | 4/1993 | Ranson | 281/21.1 |
| 5,308,208 | A | * | 5/1994 | Ranson | 412/3 |
| 5,340,155 | A | * | 8/1994 | Podosek | 281/21.1 |
| 5,403,138 | A | * | 4/1995 | Otake et al. | 281/21.1 |
| 5,605,425 | A | * | 2/1997 | Schaefer | 412/36 |
| 6,250,867 | B1 | * | 6/2001 | Gwyn et al. | 281/15.1 |
| 6,257,622 | B1 | * | 7/2001 | Peker | 281/16 |
| 6,402,450 | B1 | * | 6/2002 | Kritzinger | 270/4 |
| 2001/0041114 | A1 | * | 11/2001 | Melcher | 412/8 |
| 2002/0050710 | A1 | * | 5/2002 | Kurahashi | 281/29 |

FOREIGN PATENT DOCUMENTS

| | | | | |
|---|---|---|---|---|
| GB | 2220614 A | * | 1/1990 | 412/26 |
| NZ | WO 00/12323 | * | 3/2000 | |

* cited by examiner

*Primary Examiner*—Valencia Martin-Wallace
*Assistant Examiner*—Mark T. Henderson
(74) *Attorney, Agent, or Firm*—Clifford W. Browning; Woodard, Emhardt, Moriarty, McNett & Henry LLP

(57) ABSTRACT

A bookbinding repair kit containing instructions, diagrams and equipment to carry out repair to damaged or torn backing shoulder joints of any book, the equipment comprising a complete endpaper consisting of one evenly folded sheet of paper with a double-sided adhesive strip no less than 7 mm and no more than 10 mm in width but of a particular length, with a peel away backing paper attached to the endpaper adjacent one side of the endpaper fold, a double-sided self adhesive strip of mull cloth of a particular width and length, two thirds of each side of the mull cloth being covered with a peel away backing strip and the remaining third adhered to the adhesive side of a sconelined, one sided self-adhesive paper the same size as the endpaper, the endpaper side without the adhesive strip being glued to the plain side of the scorelined paper.

2 Claims, 3 Drawing Sheets

BOOKBINDING REPAIR KIT

Figure 1:
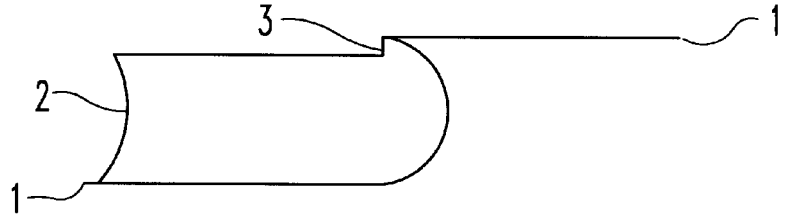
Figure 2:
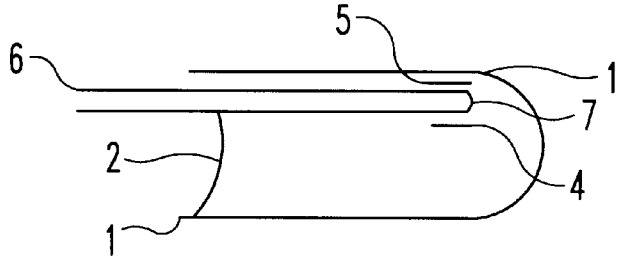
Figure 3:
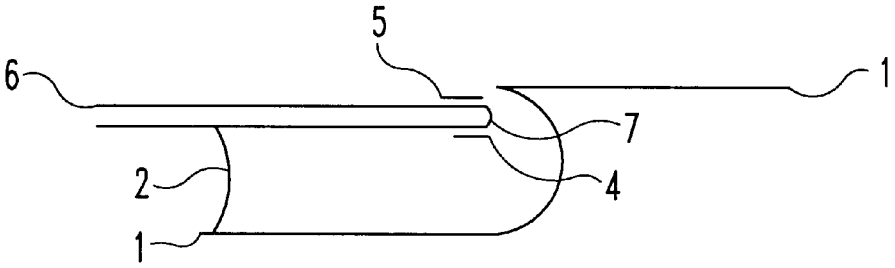
Figure 3A:
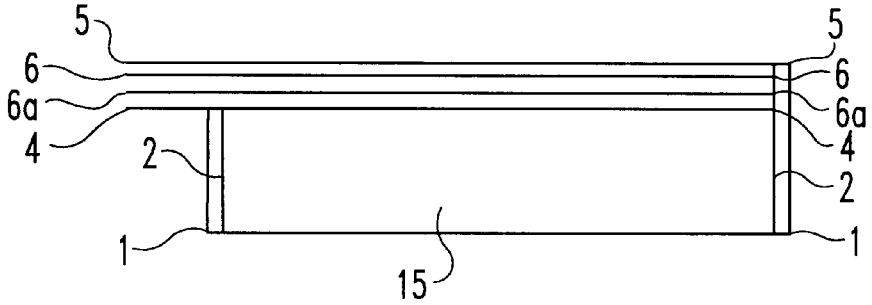
Figure 4:
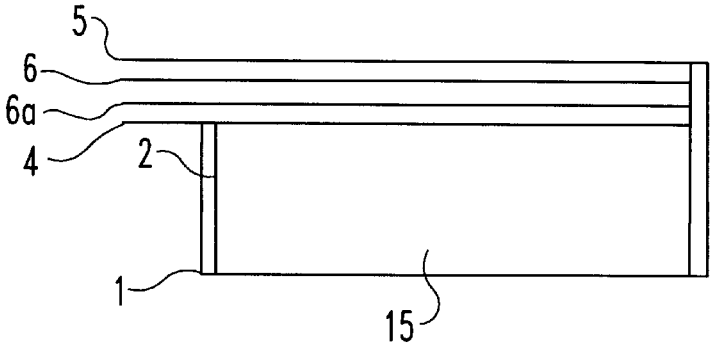
Figure 4A:
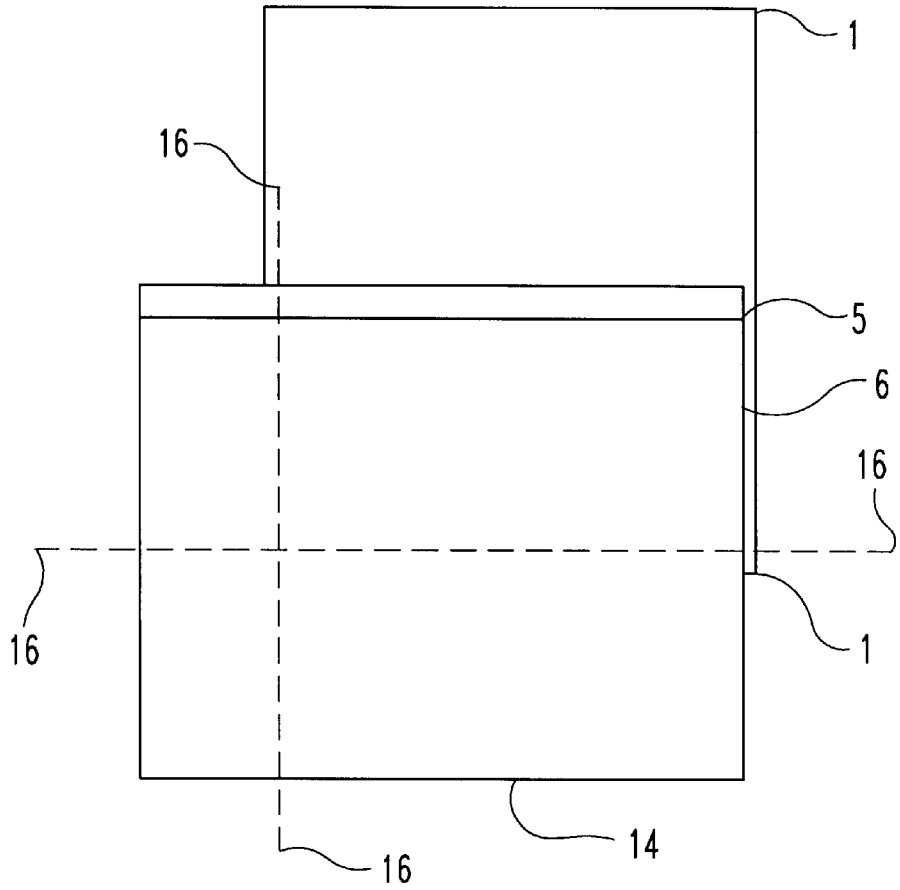
Figure 5:
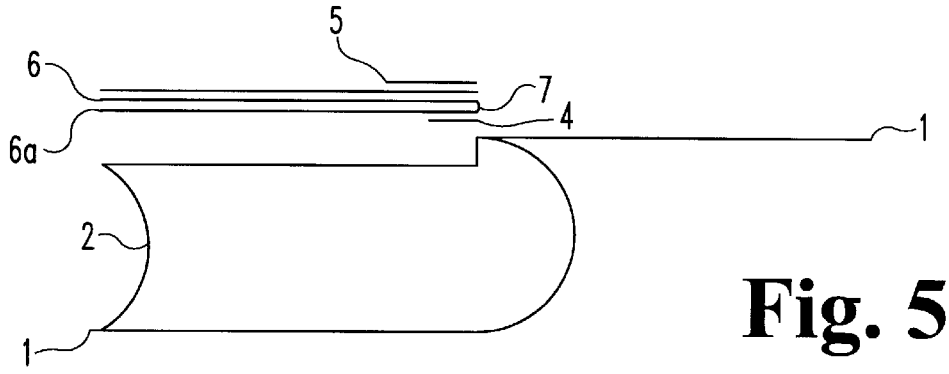
Figure 6:
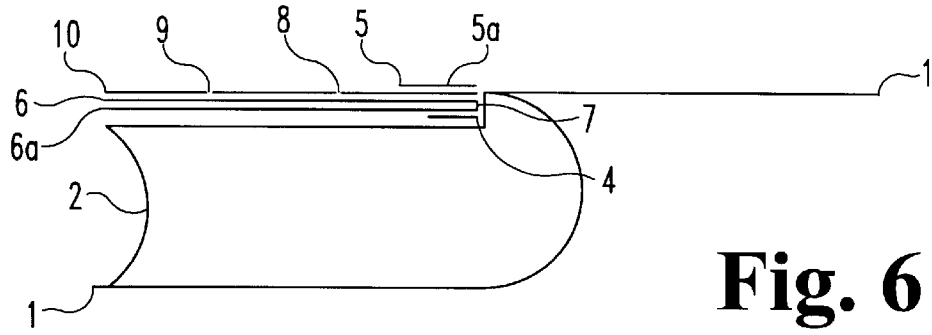
Figure 7:
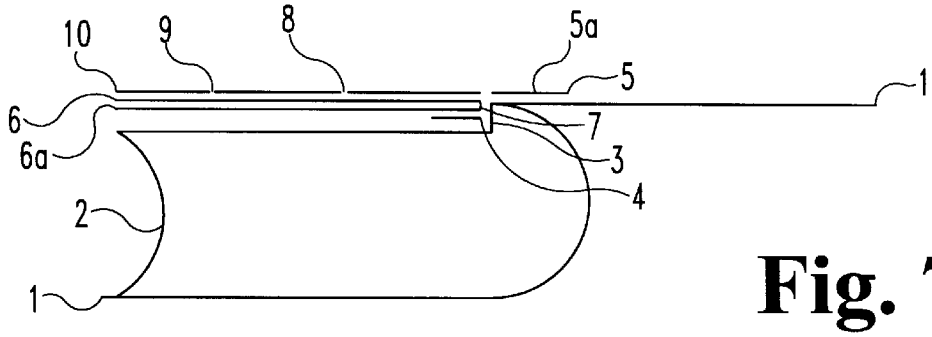

The invention herein resides in the bookbinding trade and more particularly the invention relates to a specific structure and process for repairing, securing and reinforcing damaged or torn backing shoulder joints of any book.

BACKGROUND ART

Any book is exposed to being damaged or torn at the backing shoulder joint. Either between the front cover of the book or the back cover of the book and the book contents or both.

This occurs through handling,general wearing or ageing of a book.

The prior art U.S. Pat. No. 5,017,070 provided for a repair applicable to "paperback" books only and relates to a double sided adhesive tape only.

There is no teaching art of a means to repair backing shoulder joints of a book by replacing endpapers in the world.

Accordingly there is a need in the art for a repair structure and process for damaged or torn backing shoulder joints of any book that is easy to use, inexpensive, durable and of high quality.

DISCLOSURE OF INVENTION

The main aspect of the Invention provides for a quick, quality and easy to use structure and process for repairing damaged or torn backing shoulder joints of any book.

Another aspect is that anyone who wishes to repair a backing shoulder joint of a book does not have to be skilled in bookbinding.

A further aspect is that the Invention will offer a wide range of pre-prepared endpapers from transparent to any colour, design, texture and particular size.

The structure and process of the Invention is able to be carried out economically in seven easy to follow steps with instructions.

What is claimed is:

1. A bookbinding repair kit to carry out repair to damaged or torn backing shoulder joints (3) of any book (2), the kit comprising a complete endpaper **(6, 6*a*) consisting of one evenly folded sheet of paper forming an endpaper fold (7) and having a double sided adhesive strip (4) no less than 7 mm and no more than 10 mm in width but of a particular length attached to the end paper (6, 6*a*) adjacent to the endpaper fold (7); a double sided self adhesive strip of mull cloth (5) of a particular width and length, two thirds of each side of the mull cloth being covered with a peel away backing strip (5*a*) and the remaining third adhered to an adhesive side of a two-sided scorelined paper; and a one sided self-adhesive paper the same size as the end paper (6, 6*a*), with an endpaper side without the adhesive strip (4)** being glued to a plain side of the scorelined paper.

2. A bookbinding repair kit to carry out repair to damaged or torn backing shoulder joints (3) of any book (2), the kit comprising a complete endpaper **(6, 6*a*) consisting of one evenly folded sheet of paper forming an endpaper fold (7) and having a double sided adhesive strip (4) no less than 7 mm and no more than 10 mm in width but of a particular length attached to the end paper (6, 6*a*) adjacent to the endpaper fold (7); a double sided self adhesive strip of mull cloth (5) of a particular width and length, two thirds of each side of the mull cloth being covered with a peel away backing strip (5*a*) and the remaining third adhered to an adhesive side of a two-sided scorelined paper; and a one sided self-adhesive paper the same size as the end paper (6, 6*a*), with an endpaper side without the adhesive strip (4) being glued to a plain side of the scorelined paper wherein the complete endpaper (6, 6*a*)** is of a textured, colored, or transparent paper.

* * * * *